US008435626B2

(12) United States Patent
Fang

(10) Patent No.: US 8,435,626 B2
(45) Date of Patent: May 7, 2013

(54) THERMAL DEGRADATION AND CRACK RESISTANT FUNCTIONALLY GRADED CEMENTED TUNGSTEN CARBIDE AND POLYCRYSTALLINE DIAMOND

(75) Inventor: Zhigang Zak Fang, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 1097 days.

(21) Appl. No.: 12/399,720

(22) Filed: Mar. 6, 2009

(65) Prior Publication Data

US 2009/0226688 A1 Sep. 10, 2009

Related U.S. Application Data

(60) Provisional application No. 61/034,842, filed on Mar. 7, 2008.

(51) Int. Cl.
*B32B 7/02* (2006.01)
*B32B 37/02* (2006.01)
*B05D 3/02* (2006.01)

(52) U.S. Cl.
USPC ..... 428/212; 428/218; 428/220; 428/408; 428/472; 428/698; 428/699

(58) Field of Classification Search ..... None
See application file for complete search history.

(56) References Cited

U.S. PATENT DOCUMENTS

| | | | | |
|---|---|---|---|---|
| 3,660,050 | A | 5/1972 | Iler et al. | |
| 4,610,931 | A | 9/1986 | Nemeth et al. | |
| 4,743,515 | A | 5/1988 | Fischer et al. | |
| 5,135,061 | A * | 8/1992 | Newton, Jr. | 175/428 |
| 5,279,901 | A | 1/1994 | Akerman et al. | |
| 5,413,869 | A | 5/1995 | Hartzell et al. | |
| 5,453,241 | A | 9/1995 | Akerman et al. | |
| 5,541,006 | A * | 7/1996 | Conley | 428/552 |
| 5,549,980 | A * | 8/1996 | Ostlund et al. | 428/698 |
| 5,856,626 | A | 1/1999 | Fischer et al. | |
| 5,880,382 | A | 3/1999 | Fang et al. | |
| 6,063,502 | A | 5/2000 | Sue et al. | |
| 6,214,079 | B1 * | 4/2001 | Kear et al. | 75/230 |
| 6,638,474 | B2 | 10/2003 | Liu et al. | |
| 6,641,918 | B1 | 11/2003 | Sherman et al. | |
| 6,869,460 | B1 | 3/2005 | Bennett et al. | |
| 7,097,685 | B2 * | 8/2006 | Miura et al. | 75/236 |
| 7,157,148 | B2 | 1/2007 | Takai et al. | |

(Continued)

OTHER PUBLICATIONS

American Society for Testing and Materials ("Standard Test Method for Apparent Porosity in Cemented Carbides", Annual Book of ASTM Standards, 1996).

(Continued)

*Primary Examiner* — David Sample

(74) *Attorney, Agent, or Firm* — Thorpe North & Western LLP

(57) ABSTRACT

A WC—Co material or polycrystalline diamond-Co material that has a gradient in the grain size of the particles. Specifically, the material may have a top layer that has coarse grains that is designed to dissipate the heat caused by friction (and thus prevent thermal cracking). The material will then have a bulk substrate that is made up of finer grains and provide adequate hardness for the material. The top layer is positioned on top of the bulk substrate.

12 Claims, 3 Drawing Sheets

U.S. PATENT DOCUMENTS

| | | | | |
|---|---|---|---|---|
| 7,810,587 | B2 * | 10/2010 | Gerk et al. | 175/425 |
| 8,172,914 | B2 * | 5/2012 | Mirchandani et al. | 51/295 |
| 2002/0194955 | A1 | 12/2002 | Fang et al. | |
| 2004/0009088 | A1 * | 1/2004 | Glatzle et al. | 419/14 |
| 2005/0276717 | A1 * | 12/2005 | Fang | 419/14 |
| 2006/0040104 | A1 | 2/2006 | Wort et al. | |
| 2006/0162969 | A1 * | 7/2006 | Belnap et al. | 175/433 |
| 2006/0266559 | A1 | 11/2006 | Keshavan et al. | |
| 2007/0029114 | A1 * | 2/2007 | Middlemiss | 175/374 |
| 2007/0214913 | A1 | 9/2007 | Fang | |
| 2008/0010905 | A1 | 1/2008 | Eyre | |
| 2008/0145686 | A1 * | 6/2008 | Mirchandani et al. | 428/548 |

OTHER PUBLICATIONS

Miyamoto et al. ("Functionally Graded Materials: Design, Processing and Applications", Book, Kluwer Academic Publishers, 1999).

Put et al. ("Functionally Graded WC-Co Materials Produced by Electrophoretic Deposition", Scripta Materialia 45 (2001) 1139-1145).

Eso et al., University of Utah Department of Metallurgical Engineering; A New Method for Making Functionally Graded WC-Co Composites via Liquid Phase Sintering; paper presented at PM Tec2 conference in Chicago, Illinois, Jun. 2004.

Eso, Oladapo O., University of Utah Department of Metallurgical Engineering; Sintering Studies of Functionally Graded WC-Co Composites; handout distributed at PM Tec2 conference in Chicago, Illinois, Jun. 2004.

Eso et al., University of Utah Department of Metallurgical Engineering; Liquid Phase Sintering of Functionally Graded WC-Co Composites; to appear in Int. J. of Refractory Metals and Hard Materials, 2005.

PCT International Search Authority, International Search Report, and Written Opinion of International Searching Authority, Mailed Apr. 23, 2009.

PCT International Search Authority, Written Opinion of International Searching Authority, Mailed Apr. 23, 2009.

PCT International Search Authority, Corrected PCT International Search Report for PCT, Mailed May 20, 2009.

* cited by examiner

THERMAL DEGRADATION AND CRACK RESISTANT FUNCTIONALLY GRADED CEMENTED TUNGSTEN CARBIDE AND POLYCRYSTALLINE DIAMOND

CROSS-REFERENCE TO RELATED APPLICATIONS

This application claims the benefit of U.S. Provisional Patent Application No. 61/034,842 filed on Mar. 7, 2008. This application is expressly incorporated herein by reference.

BACKGROUND OF THE INVENTION

Cemented tungsten carbide materials are known in the industry. This material constitutes a composite material of tungsten carbide (WC) that is embedded in a cobalt matrix. (Cemented tungsten carbide materials are sometimes abbreviated as "WC—Co".) Typical compositions of the cobalt metal ranges from 3 to 30 percent by weight, although other percentages of cobalt may be used. For background information regarding cemented tungsten carbide materials, the reader is invited to consult U.S. Patent Application Publication No. 2005/0276717 A1 (which publication is expressly incorporated herein by reference).

Cemented tungsten carbide materials have unique properties compared to steel, metal alloys, or ceramic materials. For example cemented tungsten carbide materials have higher hardness, wear resistance and strength, as compared to steel. However, cemented tungsten carbide materials have been known to more easily fracture than steel. In the industry, this property of the material is referred to as "fracture toughness." Fracture toughness refers to the propensity of the material to chip or fracture during use as a result of the service under mechanical loading. Thus, cemented tungsten carbide materials have less fracture toughness than steel. When compared to ceramic materials, WC—Co materials have higher fracture toughness and have equivalent or better hardness and wear resistance than do the comparable ceramic materials. Because of these unique properties, many cemented tungsten carbide materials are used in a wide range of industrial applications including metal cutting tools, mining tools, oil and gas exploration tools, and many other applications requiring extreme wear resistance.

Many WC—Co materials have a relatively low fracture toughness which limits their effectiveness in some potential applications. This low fracture toughness means that the material has a propensity to chip or fracture during use. This chipping and fracturing is especially prevalent when the WC—Co material is used as a cutter on a rock drill bit. Chipping and fracturing are the leading causes of degradation or premature failure or cemented tungsten carbide tools.

Another type of material that is used for metal cutting tools, mining tools, oil and gas exploration tools, and other similar applications is polycrystalline diamond ("PCD" or "Cd") materials. PCD materials are composed of diamond crystallite particles with a small percent of cobalt residing in the inter-particle spaces formed by the diamond crystallite particles. In many instances, PCD materials have many of the same advantageous properties that are generally associated with WC—Co materials. At the same time, many PCD materials suffer from many of the same deficiencies as WC—Co materials.

As noted above, one of the common modes of failure of tools made of WC—Co and/or PCD materials is that they tend to crack, chip, or fracture during use. Such cracking or failure of these materials is especially common when the tool become hot (as a result of the friction caused by contact with another surface). This cracking of the tool as a result of frictional heat is sometimes referred to as "heat checking." (The cracks formed by frictional heat may also be referred to as "thermal fatigue cracks"). FIG. 1 illustrates a typical appearance of tool with thermal fatigue cracks. For example, the surface 10 of the tool 14 includes one or more cracks 12 formed by heat checking.

The formation of heat checking cracks will now be described. The tool (cutter) engages the surface of a rock formation or a work piece. For example, if the tool is a rock drill mining tool or a construction tool, the tool may engage the rock formation when it is being used to cut the rock formation. Likewise, the tool may be used with a work piece in applications such as metal removal or in the formation of engineered wear parts (e.g., abrasive nozzles and seal rings). When the tool engages the surface of the rock formation or work piece, the temperature at the contact point and the adjacent surface areas increases dramatically from ambient temperature. This increase in temperature is due to intense frictional heating.

For example, in the case of cutting inserts on a lathe, the peak temperature at the tool's cutting tip can reach temperatures above 1000° C. The temperature at the contact between a rock drilling cutter and rock formations can reach temperatures above 800° C. The actual peak temperature at the cutting edge of the tool is obviously a function of surface speed (i.e., the speed at which the tool contacts the surface), the depth of cut being performed, the load (or force) applied to the surface, and, more importantly, the thermal conductivity of the cutting tool material. The thermal conductivity of the tool refers to the ability of the material to dissipate heat by conducting the heat out of the cutting contact area into other areas of the tool. When the thermal conductivity of the tool is "low," the temperature of the cutting area will be higher because the tool is not able to dissipate the heat away from the cutting area. Alternatively, if the thermal conductivity of the tool is "high," the temperature of the cutting area will be lower because some of the heat associated with the cut will be dissipated to other areas of the tool.

In order to reduce the frictional heat that is imparted to the cutting area, most cutting and drilling operations will use coolant or a cooling system to cool the tool and/or the cutting area. Then, when a coolant or cooling system is used, the cutting tool may experience drastic and sudden changes in temperature, namely, sudden heating caused by the frictional contact and then sudden cooling caused by the cooling system. These sudden changes in temperature may cause the thermal fatigue and thermal cracking of the tool.

It should also be noted that cemented tungsten carbide, and polycrystalline diamond (PCD) are essentially composites of the primary phase WC (or polycrystalline diamond) and the matrix or binder material. (Generally, the matrix or binder material is cobalt). The hard particles of the primary phase (WC or Cd) have much lower coefficients of expansion than that of the matrix ductile metal matrix phase (e.g., Co). Accordingly, the high temperature associated with tool usage also creates cyclic residual stresses between the hard particles and matrix phase. Such cyclic residual stresses can be an additional cause of heat checking cracks (thermal fatigue) of the material.

Of course, heat-checking cracks in a tool surface can propagate and get larger over time. When such cracks exceed a "critical size," the tool can no longer be safely used. At this time, the tool must be replaced and discarded, thereby increasing the overall costs of the cutting process.

Thus, there is a need in the industry for a new type of WC—Co or PCD material that may be used in industry as part of a cutting tool. In generally, this new type of WC—Co/PCD material should have high thermal conductivity such that it is capable of readily dissipating the heat caused by frictional contact with the cutting surface. Such heat dissipation would reduce the temperature at the cutting edge, thereby resulting is lower residual thermal stresses. Such dissipation of heat would also reduce the amount of heat cracking of the tool. Such new materials (as well as the tools that incorporate these materials) are disclosed herein.

BRIEF SUMMARY OF THE INVENTION

The present invention is designed to provide a new type of cemented tungsten carbide (or polycrystalline diamond) material that will address the above-mentioned problems associated with heat checking or thermal fatigue cracks. This new material will be designed by having a gradient in the grain size of the particles. Specifically, top layer (or layers) of the material will have coarser grain sizes whereas the inner layers will have finer grain sizes. This means that the size of the particles at the material's top layer is larger than the size of the particles in the inner layer(s) of the material. In many embodiments, there will be a gradient in the particle size, meaning that the particle size will gradually decrease from the larger, coarser grains at the top layer to the smaller, finer grains in the inner layer(s). (The inner layer(s) may also be referred to as the "bulk substrate"). The top layer with the coarser grain sizes essentially acts as a coating for the material. The top layer, with the coarser grain sizes, increases the thermal conductivity of the material, thereby allowing the material to more easily dissipate the frictional heat caused during use of the tool. Thus, the material is well-suited to avoid heat cracking and/or thermal fatigue. At the same time, the finer grain-sized particles throughout the inner layers of the material impart a sufficient hardness and wear resistance to the material. Accordingly, the materials of the present embodiments have the desired properties, namely high strength and wear resistance, and at the same time, resist heat cracking and/or thermal fatigue.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

DETAILED DESCRIPTION OF THE INVENTION

Figure 1:
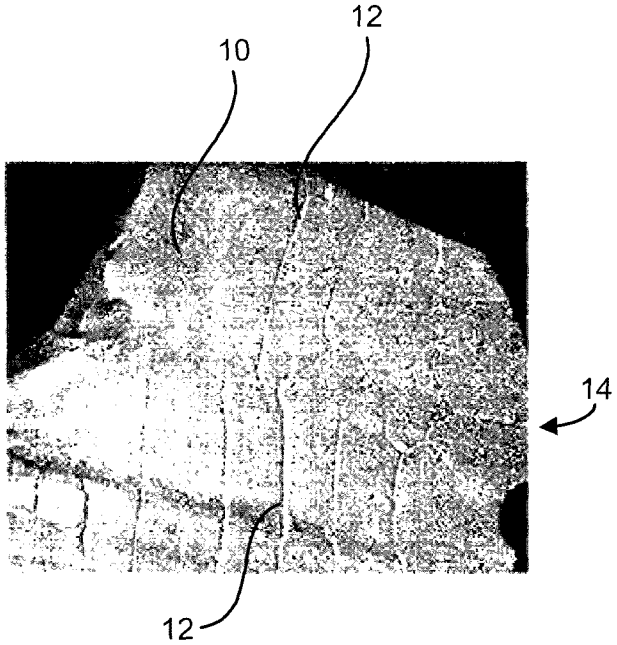
FIG. 1 illustrates a typical appearance of tool that has been experienced heat checking cracks.

The embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figures, is not intended to limit the scope of the invention, as claimed, but is merely representative of embodiments of the invention.

The present embodiments involves the understanding of how the conductivity and mechanical properties of WC—Co and PCD materials may be affected by the composition (i.e., amount of cobalt) and the microstructure (i.e., the grain size of the particles) of the material. This relationship is described herein.

The thermal conductivity of WC—Co or polycrystalline diamond materials may be a function of the composition and microstructure. (Polycrystalline diamond materials may be abbreviated as "Cd—Co" to indicate that cobalt (or another metal phase) is also present in the material). The higher the cobalt (metal) content, the lower the thermal conductivity of the composite because WC and Cd have higher thermal conductivities than the cobalt (metal) phase. (It should be noted that other transition metal binder materials, such as Fe or Ni, or their combinations, may also be used as the metal phase. Like cobalt, these other metals also have lower thermal conductivities than WC or Cd). Thus, if the cobalt (or metal) content is increased, the thermal conductivity of the material decreases because the cobalt (metal) simply cannot dissipate/transfer as much heat as the WC or Cd material.

The thermal conductivities of WC—Co or Cd—Co materials are also functions of the grain sizes. As the grain size increases, the thermal conductivity of the composite material also increases. As an individual constituent, tungsten carbide (WC) has sufficiently good thermal conductivity. In fact, the thermal conductivity of WC is higher than that of cobalt or any other transition metal binder (Fe, Ni, or their combinations) that may be used. However, a well-grown, large WC grain has better thermal conductivity than a WC grain that does not have well developed facets. Similarly, a well-grown, large Cd grain has better thermal conductivity than a Cd grain that does not have well developed facets. Therefore, a WC—Co or Cd—Co composite that has larger grain size tends to have better thermal conductivity (and hence better thermal fatigue resistance) than does a composite with smaller grains sizes or less developed facets. The reason for this is that a composite with larger grain sizes has less grain boundaries (per unit volume of the material) than a composite with finer grain sizes.

Thus, the present embodiment relies on the principles that (1) the thermal conductivity of a WC—Co or Cd—Co material may be increased by increasing the grain size of the material and (2) decreasing the cobalt content (or the amount of the metal matrix phase) will likewise increase the thermal conductivity of the material.

However, if the grain size of the WC—Co or Cd—Co material is increased, the hardness and wear resistance of the WC—Co or Cd—Co material will generally decrease. At the same time, increasing the grain size will also increase of the fracture toughness of the WC—Co materials. (This comparison assumes that the cobalt content for both materials is the same.) Similarly, using finer grain sizes will in general increase the hardness and wear resistance of the WC—Co material, but will decrease the fracture toughness of the material.

Changing the cobalt (or metal phase) content of the WC—Co or Cd—Co material will generally have a similar effect as changing the grain sizes. Higher cobalt content will increase the fracture toughness of a WC—Co or Cd—Co composite while decreasing its hardness and wear resistance.

For many industrial cutting tool applications, the hardness of the material at high temperatures (i.e., the cutting temperature) is an important feature. In general, if a material exhibits a high (acceptable) hardness at room temperature, it also exhibits a similar high (acceptable) level of hardness at the elevated cutting temperature. As noted above, such high levels of hardness are associated with the use of finer grain sizes rather than coarser grain sizes. Thus, with respect to the hardness of the material, using finer grain size would be beneficial (whereas for purposes of thermal conductivity, using coarser grain sizes is desired). Having the tool have a high (acceptable) hardness level at the cutting temperature means the tool will maintain its geometry without deforming during the extreme conditions associated with the cutting process. Deformations of the tool surface are undesirable because it may cause the tool coatings (which are often used on metal cutting tools) to fail.

In the case of PCD (assuming a constant cobalt percentage), larger diamond grain size also yields better thermal conductivity of the composite material. Larger grain size or higher cobalt content will also lead to higher impact resistance, or fracture toughness. For PCD, there are two other detrimental effects of increasing the percentage of cobalt used in the material. First, cobalt has a rather high solubility for carbon which increases as temperature increases. Thus, if the cobalt content is increased, the cobalt is more likely to dissolve the Cd structure and results in a weakened PCD structure. Second, cobalt is also prone to oxidation and corrosion at high temperatures, which would further weaken the PCD composite material. Accordingly, increasing the cobalt content may not be desirable for many PCD materials and may detrimentally affect the performance of the PCD composite material.

Based on the above-recited factors, it is clear that the effects of grain size and cobalt content are two fold. If the grain size and/or the cobalt content is increased, the thermal conductivity and fracture toughness (i.e., cracking resistance) of the WC—Co or Cd—Co material will increase. At the same time, the wear resistance and hardness of the WC—Co or Cd—Co material will decrease. Thus, in order to get high levels of hardness, a WC—Co material could be designed with a low cobalt content and coarse grain combination. However, because a coarse grain structure reduces hardness, this approach is limited in terms of the maximum hardness that can be achieved for a specific cobalt content. Assuming the cobalt content is maintained constant, to increase the hardness, finer grain sizes can be used. However, the use of finer grain sizes decreases the thermal conductivity and hence thermal crack resistance of the material. In other words, if finer grain sizes were used, that would increase the material's hardness but would decrease the material's resistance to thermal cracking. If coarser grain sizes were used, the material's resistance to thermal cracking would increase, but the material's hardness would decrease.

Figure 2:
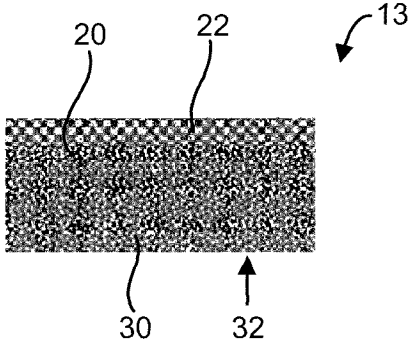
FIG. 2 is a cross-sectional view of an example of a functionally graded material.

Therefore, in order to achieve a tool with high (acceptable) hardness without sacrificing the material's resistance to thermal cracking, or vice versa, a functionally graded material ("FGM") may be constructed. An example of a functionally graded material 13 is illustrated in FIG. 2. As can be seen in FIG. 2, the material 13 may comprise a bulk substrate 30 (which may be a combination of layers) and a top surface layer 20 (which may also be a combination of layers). The top surface 20 may have a larger grain size 22 than the bulk substrate 30. The bulk substrate 30 may use finer grains 32. The top layer 20 may essentially be a coating for the bulk substrate 30. The top surface layer 20 may have a lower percentage of cobalt (metal) than the amount of cobalt used in the bulk substrate 30. The cobalt content of the top surface 20 and bulk substrate 30 may be designed so that they are in balance during liquid phase sintering. In other words, the migration pressures associated with the cobalt between the two layers is the same during the sintering process. The thickness of the top surface layer 20 is designed so that the strength of the entire composite is determined by the hardness of the bulk substrate 30. Thus, by using smaller grains in the bulk substrate 30 (which determines the level of hardness of the material, the material has a high hardness). By using larger grain size in the top surface layer 20, the temperature at the surface will be lower than if finer grain size were in the top surface 20 (due to the increased ability of the coarser grains to dissipate the frictional heat). Hence, the thermal cracking resistance of the entire composite is better than if the entire material is made of fine grains.

It should be noted that the above-recited example is given with respect to WC—Co materials. Similar types of materials may be designed using PCD materials. For example, a Cd—Co material may be made in which the top surface has coarser grains and the bulk substrate has finer grains, thereby achieving the same type of properties discussed above.

The exact grain sizes used (for both the top layer with "coarse" grains and the bulk substrate with "fine" grains) may be selected according to the particular embodiment. Any number of grain sizes may be used, as appropriate. One skilled in the art would appreciate how to change the grain sizes of both the top layer and the bulk substrate.

It should also be noted that the above-recited embodiments are designed in which the top layer (at the surface) has coarser grains whereas the bulk substrate has finer grains. Those skilled in the art would appreciate that other embodiments may be designed in which the top layer has finer grains and the bulk layer has coarser grains. Obviously, changing the layers in this manner would affect the properties of the WC—Co or Cd—Co material.

It should also be noted that the above-recited embodiments may be designed in which the coarse grains are a layer on top of the bulk substrate. Other embodiments may be designed in which the transition between coarse grains to fine grains is not a sudden, discrete change. Rather, embodiments may be formed in which a "gradient" in the grain size is formed, meaning that the size of the grains will gradually change in accordance with the depth of the material.

Those skilled in the art will appreciate that a variety of different embodiments may be constructed in which the top layer or area has coarser grains whereas the bulk substrate has finer grains. The following is a description of one or more of the embodiments that may be constructed.

- the grain size of the top layer may be at least 30% larger than that of the bulk substrate (because having this differential in the grain sizes may produce better results);
- the cobalt content of the top layer may be higher or lower or equal to that of the bulk substrate layer;
- the thickness of the top layer may be between 0.01 to 3.0 mm;
- the hardness of the top layer may be lower or equal to that of the bulk substrate;
- the bulk substrate may consists of WC—Co or Cd—Co materials with cubic carbide additives, such as TiC and TaC;
- the top layer may have lower cubic carbide contents than that of the bulk substrate (or vice versa, as desired);
- in some embodiments, the top surface layer may have no or only a trace of cubic carbide constituents (such as TiC or TaC);

in some embodiments, the bulk substrate may contain grain growth inhibitors;

in some embodiments, the top surface layer contains a smaller amount of grain growth inhibitors than is present in the bulk substrate (and, in fact, in other embodiments, the top surface layer will have no grain growth inhibitors or only trace amounts of the grain growth inhibitors); and the thermal conductivity of top surface layer may be higher than that of the bulk substrate.

It should be noted that coarse WC or Cd grains could range in size from 1 micron to 40 microns. Fine WC or Cd grains could range in size from 0.1 microns to 10 microns. In other embodiments, fine grains may range from about 0.5 to about 3 microns, and coarse grain may range from about 5 to about 30 microns. In one embodiment, grain size means "average grain size." Actual materials may have a grain size distribution. Thus, in one embodiment, the surface layer grain size is larger than that of the bulk of the material. For embodiments involving PCD, the average size of the coarse grains may be from about bout 20 to about 60 microns whereas the average size of the fine grains may range in average size from about 0.5 or 1 to about 30 microns.

Figure 3:
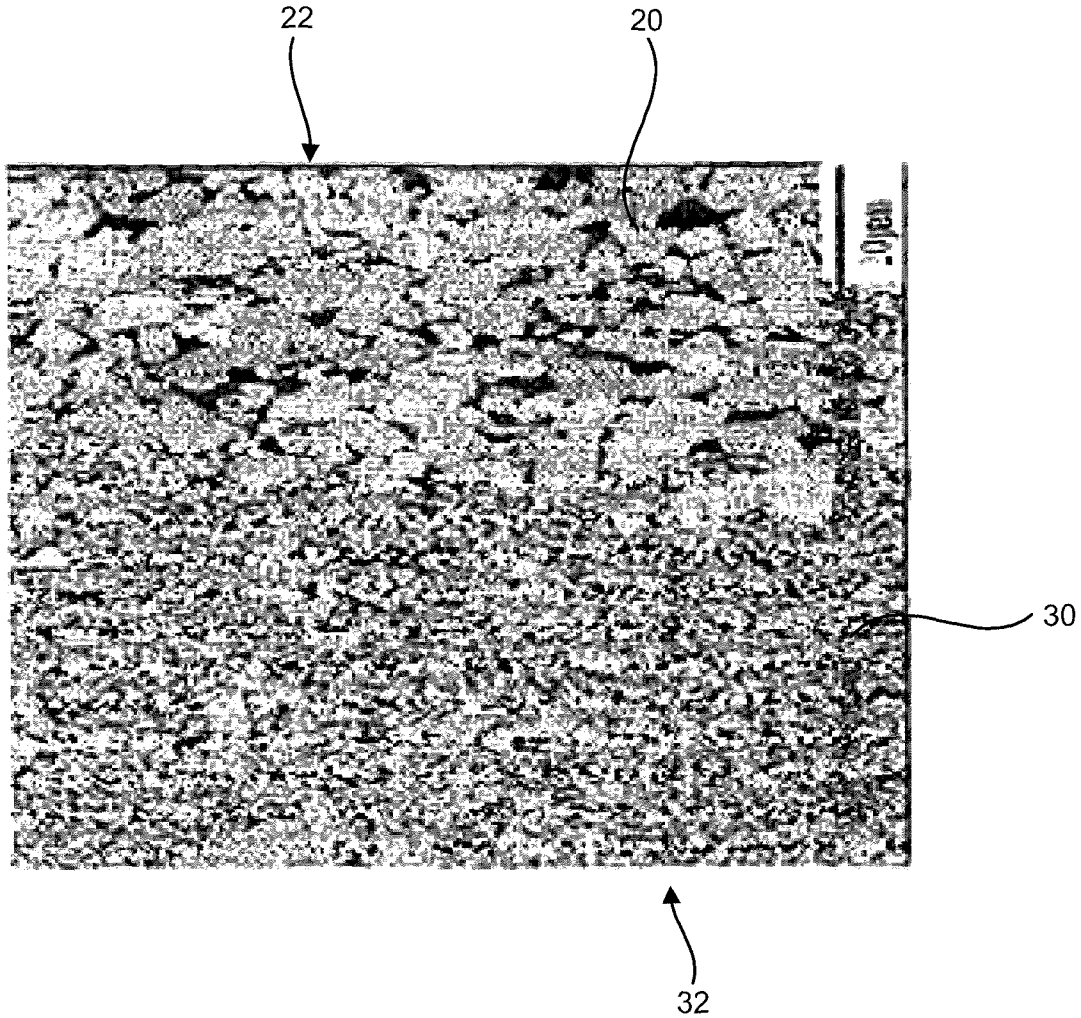
FIG. 3 is a micrograph of an embodiment showing the top surface layer adjoining a bulk substrate.

FIG. 3 is a micrograph of the top surface layer adjoining to the bulk substrate. (The scale on the upper right hand corner of FIG. 3 indicates 20 μm). For example, FIG. 3 illustrates one embodiment of a structure with the top layer 20 with course grain sizes 22 and the bulk substrate 30 having fine grain sizes. In some embodiments, the thickness of the top layer 20 may be between about 0.01 to about 1.0 millimeters.

There are a variety of different manufacturing methods that may be used to construct the functionally graded materials described herein. Both WC—Co and PCD may be made by powder metallurgy processes. The first step may involve preparing powders of desired compositions. The second step may be to compact and form the powder to a desired geometric shape. The third step may be to sinter the compact into a fully densified solid material. Depending on the specific material being constructed, the specific details of the above-recited steps may vary, as appreciated by those skilled in the art. For example, PCD materials may be sintered under extremely high pressure (5-7 GPa) at 1400-1500° C., while WC—Co materials are typically sintered in vacuum at temperatures from 1360 to 1500° C. Sinter-HIP processes involving vacuum sintering followed by low pressure hot isostatic pressing with 1 to 10 MPa pressure in one single furnace run are also common in modern manufacturing operations.

To manufacture the functionally graded WC—Co (or PCD) materials containing a top surface layer with large grains and a bulk substrate with finer grains, several manufacturing methods can be used. One method may include the following steps:

1. Prepare two separate powder mixtures, one with the top surface layer composition and grain size, and the other with the bulk composition and grain size;

2. If using die compaction to fabricate green compact, apply and spread the top surface layer powder on the inner wall of the die cavity first, then fill the die with the bulk substrate material powder; and 3. Press and sinter.

Another alternative method may include the following steps:

1. Prepare the top surface layer powder into a slurry;

2. Compact the bulk substrate powder separately;

3. Dip coat the substrate in the slurry of the top surface layer powder; and

4. Sinter.

The additional step of pressing may optionally be used.

Another approach may involve creating a surface with large grains in-situ during sintering may be formed as follows:

1. Prepare one powder mixture,

2. Sinter in a controlled and custom engineered atmosphere that promotes grain growth.

However, during the process of this step (step 2.), the depth of enhanced grain growth may be controlled to obtain a desired thickness of the top surface layer. For example, the starting powder mixture of WC and Co may be made to have lower than stoichiometric carbon content. During sintering, the compact may be allowed to densify first to near full density or until all pores that are not connected to the surface are closed. Then, the material may be introduced into the furnace a carburizing atmosphere. Due to the high carbon content in the atmosphere, carbon may diffuse into the material from the surface. During that process, the surface layer may have higher carbon content than the interior, thus there will be more pronounced grain growth at and near the surface layer that in the interior. By controlling the kinetics of the diffusion process, a differential grain growth may be achieved between the surface layer and the interior bulk of the material.

The patent application referenced above (namely, U.S. Patent Application Publication No. 2005/0276717 A1) discloses methods for creating a gradient in the amount of cobalt used in the material. It should be noted that the methods of this application may be combined with the present methods, thereby creating a material that has both a cobalt gradient and a gradient in the grain size. For example, the cobalt may migrate in the direction of finer grain sizes and/or in the direction of carbon diffusion. Therefore, one can prepare two powders with different grain sizes. The coarse grain size powder may be made to have higher carbon content than the powder with finer grain sizes. Using one of the disclosed green compaction methods, the coarse-grain powder may be compacted as a surface layer on the top of a substrate made of the finer-grain powder. When subjected to sintering, due to the initial difference in both the grain size and the carbon content, cobalt may migrate to the interior of the part because it has finer grain size and because carbon is diffusion from the carbon rich surface layer to the carbon deficient interior. The final microstructure may therefore consists of a coarse grained surface layer with lower cobalt content than the bulk substrate, which has a finer grain size and higher cobalt content. The hardness of the top surface layer, as a result of the microstructure, may therefore be either lower, or higher, or equal to that of the bulk substrate.

Those skilled in the art will appreciate that there are a variety of different applications for the materials disclosed herein. They include rock drilling tools, metal cutting tools, mining tools, oil and gas exploration tools, and any other application of WC—Co/PCD materials (including other applications requiring extreme wear resistance).

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A functionally graded material that is comprised of tungsten carbide or polycrystalline diamond with a metal binder, the metal binder distributed between grains of the tungsten carbide or diamond of the polycrystalline diamond, the material comprising a bulk substrate and a top layer, wherein the top layer and the bulk substrate are comprised of grains of different sizes, the top layer being comprised of grains that have an average size from about 5 to about 40 microns and the bulk substrate being comprised of grains that have an average size from about 0.1 to about 10 microns, wherein there is a gradient in grain sizes such that grain sizes decrease from the top layer toward the bulk substrate.

2. The material of claim 1 wherein the metal binder is cobalt.

3. The material as in claim 1 wherein the average size of the grains in the top layer is at least 30% larger than the average size of the grains in the bulk substrate.

4. The material as in claim 1 wherein the top layer has a thickness that is between 0.01 millimeters to 1.0 millimeters.

5. The material as in claim 1 further comprising cubic carbide additives, wherein the additives are present in the bulk substrate but are not present in the top layer.

6. The material as in claim 1 further comprising grain growth inhibitors, wherein the inhibitors are present in the bulk substrate but are not present in the top layer.

7. The material as in claim 1 wherein the thermal conductivity of the top layer is higher than the thermal conductivity of the bulk substrate.

8. The material as in claim 1 wherein the metal binder includes cobalt, and the cobalt content of the top layer is greater than or equal to the cobalt content of the bulk substrate.

9. The material as in claim 1 wherein the thickness of the top layer is designed so that the compressive strength of the entire composite is primarily determined by the properties of the bulk substrate.

10. The material of claim 1 wherein the top layer is comprised of grains that range in size from about 5 to about 30 microns and wherein the bulk substrate is comprised of grains that range in size from about 0.5 to about 3 microns.

11. A method for creating a functionally graded material comprised of tungsten carbide or polycrystalline diamond with a metal binder, the metal binder distributed between grains of the tungsten carbide or diamond of the polycrystalline diamond, the material comprising a bulk substrate and a top layer, wherein the top layer and the bulk substrate are comprised of grains of different sizes, the top layer being comprised of grains that have an average size from about 5 to about 40 microns and the bulk substrate being comprised of grains that have an average size from about 0.1 to about 10 microns, wherein there is a gradient in grain sizes such that grain sizes decrease from the top layer toward the bulk substrate, the method comprising:

preparing two separate powder mixtures, one of the mixtures being a composition that corresponds to the grain size of the top surface layer composition and the other being a composition that corresponds to the grain size of the bulk substrate;

applying and spreading the top layer mixture on the inner wall of a die cavity;

filling the remainder of the die cavity with the bulk substrate mixture;

pressing the die cavity together; and sintering.

12. A method for creating a functionally graded material comprised of tungsten carbide or polycrystalline diamond with a metal binder, the metal binder being distributed between grains of the tungsten carbide or diamond or diamond of the polycrystalline diamond, the material comprising a bulk substrate and a top layer, wherein the top layer and the bulk substrate are comprised of grains of different sizes, the top layer being comprised of grains that have an average size from about 5 to about 40 microns and the bulk substrate being comprised of grains that have an average size from about 0.1 to about 10 microns, wherein there is a gradient in rain sizes such that rain sizes decrease from the top layer toward the bulk substrate, the method comprising:

preparing the top surface layer mixture into a slurry;

compacting the bulk substrate powder separately;

coating the substrate with the slurry; and sintering.

* * * * *